US010999906B1

(12) United States Patent
Lan et al.

(10) Patent No.: US 10,999,906 B1
(45) Date of Patent: May 4, 2021

(54) SELF-ADAPTIVE ILLUMINATING DEVICE

(71) Applicant: XIAMEN ECO LIGHTING CO. LTD., Xiamen (CN)

(72) Inventors: Tian Lan, Xiamen (CN); Jianxin Xie, Xiamen (CN); Liping Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/822,762

(22) Filed: Mar. 18, 2020

(51) Int. Cl.
*H05B 45/14* (2020.01)
*H05B 47/165* (2020.01)
*H05B 45/325* (2020.01)

(52) U.S. Cl.
CPC ..... *H05B 45/14* (2020.01); *H05B 45/325* (2020.01); *H05B 47/165* (2020.01)

(58) Field of Classification Search
CPC ..... H05B 45/14; H05B 45/36; H05B 45/37; H05B 45/165; H05B 45/325
See application file for complete search history.

(56) References Cited

U.S. PATENT DOCUMENTS 8,674,615 B2 * 3/2014 Koutensky ..... H05B 45/37 315/219
10,306,717 B1 * 5/2019 Yau ..... H02M 1/34
2005/0253533 A1 * 11/2005 Lys ..... F21K 9/238 315/224
2007/0040516 A1 * 2/2007 Chen ..... H05B 39/045 315/291
2007/0229001 A1 * 10/2007 McIntosh ..... H02M 3/156 315/307
2011/0248639 A1 * 10/2011 Peker ..... H05B 45/37 315/192
2011/0309759 A1 * 12/2011 Shteynberg ..... H05B 45/10 315/201
2012/0025736 A1 * 2/2012 Singh ..... H05B 45/382 315/307
2012/0081009 A1 * 4/2012 Shteynberg ..... H05B 45/46 315/122
2013/0038227 A1 * 2/2013 Yan ..... H05B 45/37 315/186
2013/0127361 A1 * 5/2013 Weng ..... H05B 45/37 315/224
2014/0009084 A1 * 1/2014 Veskovic ..... H05B 33/08 315/307

(Continued)

*Primary Examiner* — Amy Cohen Johnson
*Assistant Examiner* — Syed M Kaiser
(74) *Attorney, Agent, or Firm* — Chun-Ming Shih; Lanway IPR Services

(57) ABSTRACT

A self-adaptive illuminating device includes an illuminating unit, a sampling module, a sampling transformation module, a control module and a power transformation module. The sampling module samples at least one electrical property of the illuminating unit to generate a first feedback signal in response to a test signal. The sampling transformation module filters out noises off the first feedback signal for generating a second feedback signal. The control module generates an operation signal that carries at least one operational parameter of the illuminating unit in response to the second feedback signal. The power transformation module generates a drive voltage corresponding to an input voltage and the operation signal. The power transformation module drives the illuminating unit using the drive voltage.

17 Claims, 5 Drawing Sheets

(56) References Cited

U.S. PATENT DOCUMENTS

| | | | | |
|---|---|---|---|---|
| 2014/0111113 | A1* | 4/2014 | Del Carmen, Jr. .... | H05B 45/37<br>315/297 |
| 2014/0132182 | A1* | 5/2014 | Angeles ..... | H05B 45/10<br>315/294 |
| 2014/0152183 | A1* | 6/2014 | Kim ..... | H05B 45/37<br>315/155 |
| 2015/0318685 | A1* | 11/2015 | Hsieh ..... | H02H 7/20<br>363/53 |
| 2019/0267843 | A1* | 8/2019 | Cooke ..... | H02J 50/12 |
| 2020/0037408 | A1* | 1/2020 | DeJonge ..... | H05B 45/39 |

* cited by examiner

SELF-ADAPTIVE ILLUMINATING DEVICE

FIELD OF THE INVENTION

The present invention relates to an illuminating device, and more particularly, to a self-adaptive illuminating device.

BACKGROUND OF THE INVENTION

A light emitting diode (LED) is highly sensitive in its electrical properties. Also, a LED's is broadly utilized for its low power consumption, long life cycle and small maintenance.

For driving a LED, a driving power, which includes at least a driving voltage and a driving current, must be precisely provided to the LED. Such that the LED can have good protection. Specifically, the LED requires matching electrical properties for its driving.

Ordinarily, a LED requires appropriate operating parameters for its constant current amplitude and target power output. Therefore, the operating parameters are required to be designed in a manner that fits the LED's operations. However, because of the nature that the LED's driving and illuminating are strictly independent from each other, it requires significantly skilled human knowledge in fabricating and installing the LED. Otherwise, the LED will not effectively prevent itself from numerous fabrication errors and/or installation errors.

SUMMARY OF THE INVENTION

The present disclosure aims at disclosing a self-adaptive illuminating device, which includes an illuminating unit, a sampling module, a sampling transformation module, a control module and a power transformation module. The sampling module is electrically coupled to the illuminating unit. Also, the sampling module samples at least one electrical property of the illuminating unit to generate a first feedback signal in response to a test signal. The sampling transformation module is electrically coupled to the sampling module. In addition, the sampling transformation module filters out noises off the first feedback signal for generating a second feedback signal. The control module is electrically coupled to the sampling transformation module. Moreover, the control module generates an operation signal that carries at least one operational parameter of the illuminating unit in response to the second feedback signal. The power transformation module is electrically coupled to the control module. And the power transformation module generates a drive voltage corresponding to an input voltage and the operation signal. Moreover, the power transformation module drives the illuminating unit using the drive voltage. In one example, the control module stores associations between values of the test signal, the feedback signals and the operation signal.

In one example, the values of the test signal include values of test voltages, test currents, test pulse-width-modulation (PWM) signals, and/or test carrier signals. Also, the values of the feedback signals include values of feedback voltages, feedback currents, feedback PWM signals, and/or feedback carrier signals. And the values of the operation signal, i.e., the at least one operational parameter, include values of operational voltages, operational currents, operational PWM signals, and/or operations carrier signals.

In one example, the control module generates a control signal, and the power transformation module generates the test signal based on the control signal. In addition, the illuminating unit is not activated via the test signal.

In one example, the sampling transformation module includes a signal transformation unit, a photo-coupling isolation unit and an auxiliary unit. The signal transformation unit is electrically coupled to the sampling module. Also, the signal transformation unit generates a third feedback signal based on the first feedback signal. The photo-coupling isolation unit is electrically coupled to the signal transformation unit. And the signal transformation unit performs photo-coupling isolation on the third feedback signal for generating the second feedback signal. The auxiliary unit is electrically coupled to the signal transformation unit for powering up the signal transformation unit.

In one example, the signal processing unit references association between values of the second feedback signal and the operational signal for determining at least one operation parameter to be utilized by the illuminating unit.

In one example, the signal transformation unit generates the test signal upon activating the self-adaptive illuminating device.

In one example, the sampling module is electrically coupled to the illuminating unit in parallel.

In one example, the sampling module is electrically coupled to the illuminating unit in series.

In one example, the sampling module includes at least one of a light-emitting diode (LED), a resistor, an inductor, a capacitor, an integrated circuit, and a microcontroller unit.

In one example, the sampling module is integrated with the illuminating unit.

In one example, the control module includes a signal processing unit and a switch unit. The signal processing unit is electrically coupled to the sampling transformation module. Also, the signal processing unit generates the operation signal, a first control signal and a first switch signal in response to the second feedback signal. The switch unit is electrically coupled to the signal processing unit and the power transformation module. In addition, the switch unit switches on or off the first control signal based on the first switch signal.

In one example, the signal processing unit includes a microcontroller, a first n-type bipolar junction transistor (BJT) and a second n-type BJT. The microcontroller has: (1) a power terminal that is electrically coupled to an input power source; (2) a ground terminal that is electrically coupled to ground; and (3) a first data I/O terminal that is electrically coupled to the switch unit. The first n-type bipolar junction transistor (BJT) has: (1) an emitter that is electrically coupled to a second data I/O terminal of the microcontroller and ground; and (2) a collector that is electrically coupled to the input power source and the power transformation module. The second n-type BJT has: (1) a collector that is electrically coupled to a base of the first n-type BJT and the collector of the first n-type BJT; and (2) a base that is electrically coupled to the second data I/O terminal and an emitter of the second n-type BJT.

In one example, the signal processing unit also includes a first resistor, a second resistor, a third resistor, a fourth resistor and a fifth resistor. The first resistor is electrically coupled between the second data I/O terminal of the microprocessor and the base of the second n-type BJT. The second resistor is electrically coupled between a third data I/O terminal of the microprocessor and the collector of the first n-type BJT. The third resistor is electrically coupled between the base and the emitter of the second n-type BJT. The fourth resistor is electrically coupled between the collector of the second n-type BJT and the input power source. The fifth resistor is electrically coupled between the collector of the first n-type BJT and the input power source.

In one example, the microcontroller further has: (1) a fourth data I/O terminal that is electrically coupled to a photo-coupling isolation unit of the sampling transformation module; (2) a fifth data I/O terminal that is electrically coupled to the switch unit for controlling a PWM status of the switch unit; and (3) a sixth data I/O terminal that is electrically coupled to a main power source.

In one example, the sampling transformation module includes a photo-coupling isolation unit and a signal transformation unit. And the signal transformation unit includes a socket chip. Specifically, the socket chip has: (1) a test terminal that is electrically coupled to the sampling module; (2) a primary power terminal that is electrically coupled to a main power source; (3) a ground terminal and a secondary power terminal electrically coupled to each other; (4) an output terminal electrically coupled to the photo-coupling isolation unit; and (5) a program terminal electrically coupled to the sampling module.

In one example, the signal transformation unit further includes a first capacitor, a second capacitor, a third capacitor, a first resistor, a first diode, a second diode, a second resistor and a third resistor. The first capacitor is electrically coupled between the test terminal and the program terminal of the socket chip. The second capacitor is electrically coupled between the primary power terminal and the ground terminal of the socket chip. The third capacitor is electrically coupled to the second capacitor in parallel. The first resistor has a first terminal that is electrically coupled to the test terminal of the socket chip. The first diode has: (1) a positive terminal that is electrically coupled to a second terminal of the first resistor; and (2) a negative terminal that is electrically coupled to the sampling module. The second diode is electrically coupled between the test terminal and the primary power terminal of the socket chip. The second resistor is electrically coupled between the test terminal and the output terminal of the socket chip. The third resistor is electrically coupled between the output terminal and the ground terminal of the socket chip. And the third resistor is further electrically coupled between two terminals of the photo-coupling isolation unit.

In one example, the sampling module includes a sampling resistor that is electrically coupled to the illuminating unit in parallel or in series.

In one example, the power transformation module includes a power transforming unit, a power factor calibration unit, a rectifying unit, a DC voltage transformation unit, a total voltage testing unit, a drive controlling unit and a DC sampling unit. The power transforming unit is electrically coupled to the control module. Also, the power transforming unit generates the test signal using a first control signal. The power factor calibration unit is electrically coupled to the power transforming unit. In addition, the power factor calibration unit generates a calibration signal based on a rectified voltage. The rectifying unit is electrically coupled to the power factor calibration unit. Additionally, the rectifying unit rectifies the input voltage to generate the rectified voltage. The DC voltage transformation unit is electrically coupled to the rectifying unit and the illuminating unit. The total voltage testing unit is electrically coupled to the rectifying unit and the power transformation unit. Moreover, the total voltage testing unit tests the rectified voltage to generate the test signal. The drive controlling unit is electrically coupled to the power transformation unit and the DC voltage transformation unit. And the drive controlling unit generates a drive signal based on the test signal. The DC sampling unit is electrically coupled to the power transformation unit. Also, the DC sampling unit samples the drive voltage to generate a sample signal. The DC voltage transformation unit additionally performs AC-to-DC voltage transformation on the rectified voltage, and adjusts the rectified voltage using the drive signal for generating the drive voltage.

In one example, the power transformation unit includes a power transformation chip. Specifically, the power transformation chip has that at least one data I/O terminal. And the at least one data I/O terminal is electrically coupled to the control module, the power factor calibration unit, the total voltage testing unit, the drive controlling unit, and the DC sampling unit.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present disclosure discloses a self-adaptive illuminating device capable of avoiding unnecessary installation that introduces errors.

Figure 1:
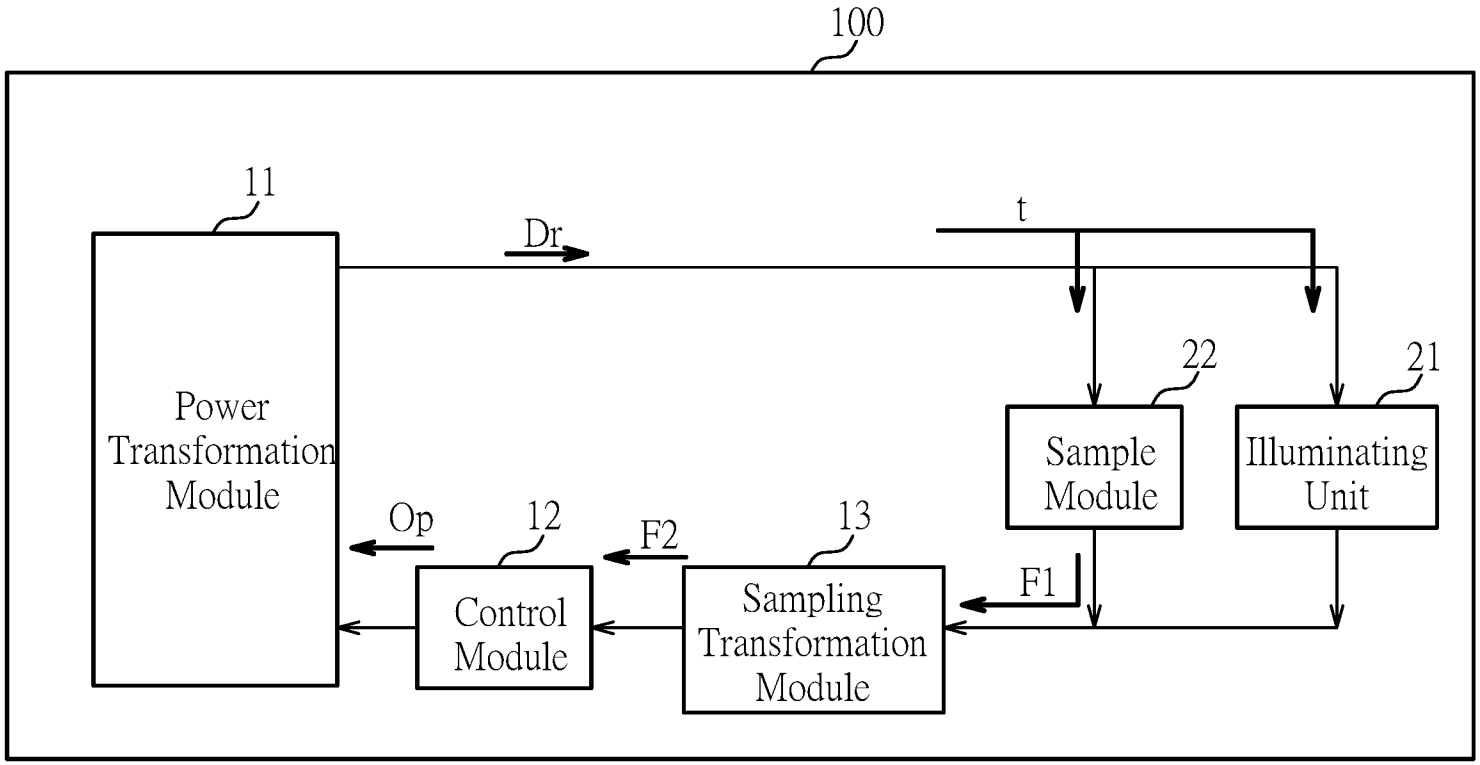
FIG. 1 illustrates a schematic diagram of a self-adaptive illuminating device according to one embodiment.

FIG. 1 illustrates a schematic diagram of a self-adaptive illuminating device 100 according to one embodiment of the present invention. The self-adaptive illuminating device 100 includes an illuminating unit 21, a sampling module 22, a sampling transformation module 13, a control module 12 and a power transformation module 11.

The sampling module 22 is electrically coupled to the illuminating unit 21, e.g., in parallel or in series. Also, the sampling module 22 samples at least one electrical property of the illuminating unit 21. Such that the sampling module 22 generates a first feedback signal F1 in response to a test signal t. Additionally, in some examples, the sampling module 22 includes at least one of a light-emitting diode (LED), a resistor, an inductor, a capacitor, an integrated circuit, and/or a microcontroller unit. Moreover, in some examples, the sampling module 22 is integrated with the illuminating unit 21 for more precise sampling without substantially introducing the illuminating unit 21's additional power consumption.

Figure 4:
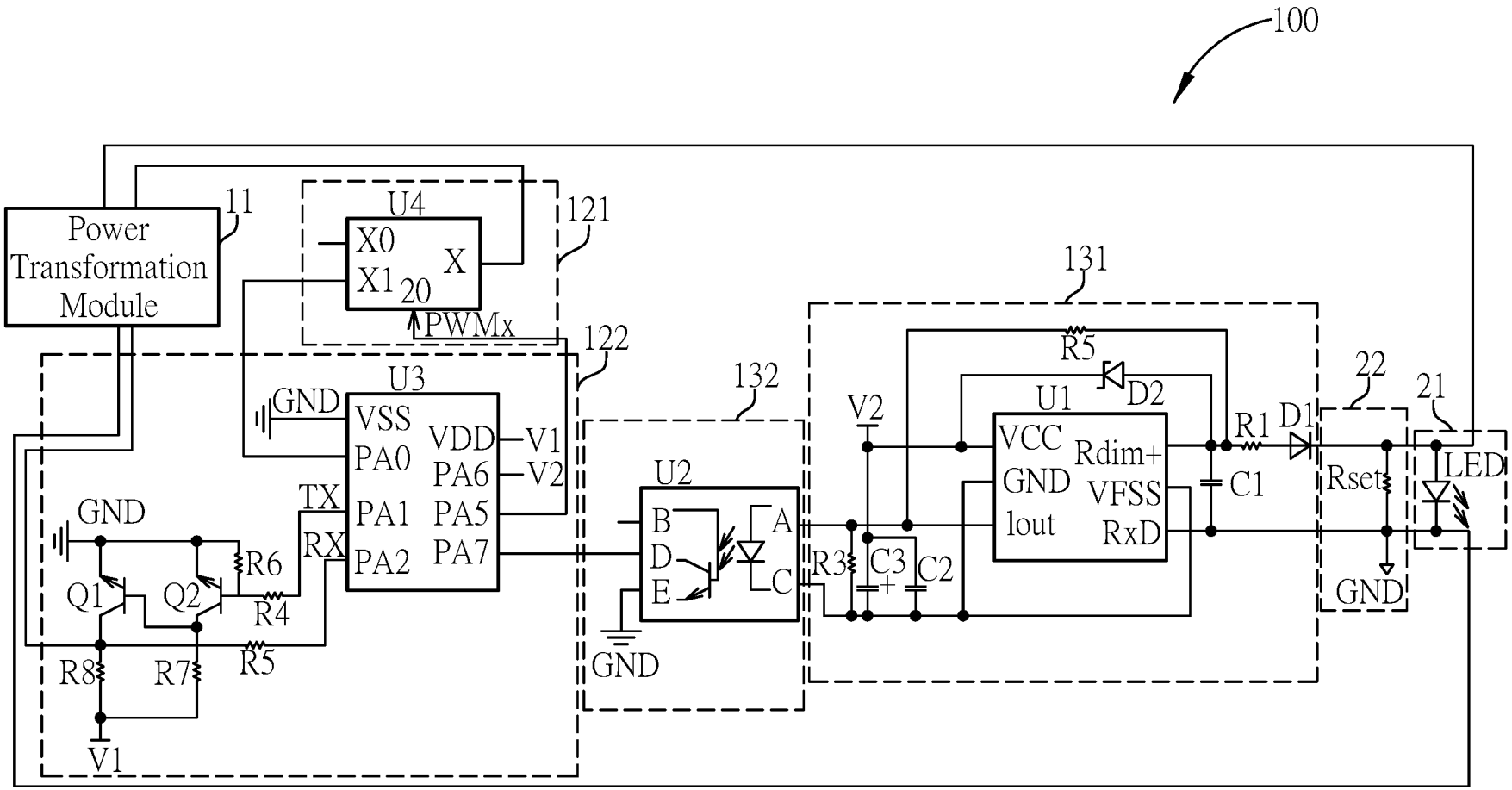
FIG. 4 illustrates an exemplary detailed circuit diagram of the self-adaptive illumination device according to one example.

In some examples, the sampling module 22 is implemented using a sample resistor Rset, as shown in FIG. 4.

The sampling transformation module 13 is electrically coupled to the sampling module 22. In addition, the sampling transformation module 13 filters out noises off the first feedback signal F1 for generating a second feedback signal F2.

The control module 12 is electrically coupled to the sampling transformation module 13. Moreover, the control module 12 generates an operation signal Op that carries at least one operational parameter of the illuminating unit 21 in response to the second feedback signal F2.

The power transformation module 11 is electrically coupled to the control module 12. And the power transformation module 11 generates a drive voltage Dr corresponding to an input voltage V1 and the operation signal Op. In other words, the drive voltage Dr references to the at least one operational parameter that the operational signal Op carries. Moreover, the power transformation module 11 drives the illuminating unit 21 using the drive voltage Dr.

As the self-adaptive illuminating device 100 keeps operating, the sampling module 22 simultaneously samples at least one electrical property of the illuminating unit 21. Such that the control module 12 can always determine the operation signal Op's at least one operational parameter in a way that precisely and instantly responds to any change of the illuminating unit 21's at least one sampled electrical property. In this way, the illuminating unit 21 can always illuminate properly in response to its electrical property changes. Therefore, the self-adaptive illuminating device 100 is substantially free from installation errors and/or fabrication errors mentioned above.

Specifically, every time when the illuminating unit 22 is tested, the control module 12 records an association history between values of the test signal t, the feedback signals F1 and F2, and the operation signal Op (specifically, its operational parameters). In this fashion, the control module 12 can always reference to the association history, immediately respond to the instant test signal t and the feedback signals F1 and F2, and correspondingly generate the instantly-required operation signal Op.

After receiving the test signal t, the illuminating unit 21 reflects with its at least one electrical property that is later sampled by the sampling module 22. In some examples, the test signal t includes various values of, e.g., test voltages, test currents, test pulse-width-modulation (PWM) signals, and/or test carrier signals. Similarly, in some examples, the values of the feedback signals F1 and/or F2 include values of feedback voltages, feedback currents, feedback PWM signals, and/or feedback carrier signals. Correspondingly, values of the operation signal Op, i.e., the at least one operational parameter, include values of operational voltages, operational currents, operational PWM signals, and/or operations carrier signals.

For generating the test signal t, the control module 12 generates a control signal C. And the power transformation module 11 then generates the test signal t based on the control signal C.

In some examples, the power transformation module 11 additionally receives input power from an external input power source and references the operation signal Op to generate the drive signal Dr. Such that the power transformation module 11 drives the illuminating unit 21 using the drive signal Dr.

Figure 2:
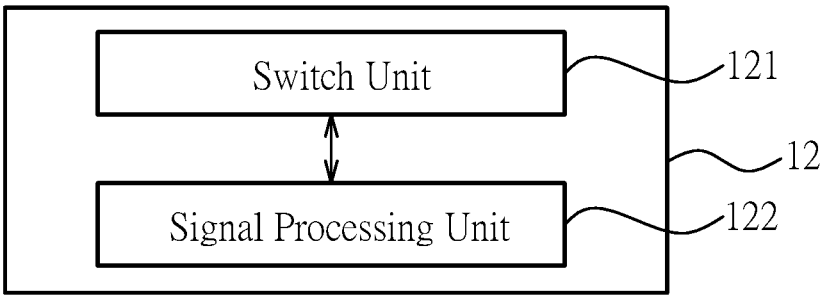
FIG. 2 illustrates a detailed schematic diagram of the control module shown in FIG. 1 according to one example.

In some examples, the illuminating unit 21 includes at least one light-emitting diode (LED) or even multiple sets of LEDs, according to various illumination requirements. FIG. 2 illustrates a detailed schematic diagram of the control module 12 shown in FIG. 1 according to one example. Specifically, the control module 12 includes a signal processing unit 122 and a switch unit 121.

The signal processing unit 122 is electrically coupled to the sampling transformation module 13. Also, the signal processing unit 122 generates the operation signal Op, the control signal C and a first switch signal SW1 in response to the second feedback signal F2. In some examples, the signal processing unit 122 references association between values of the second feedback signal F2 and the operational signal Op for determining at least one operation parameter to be utilized by the illuminating unit 21.

The switch unit 121 is electrically coupled to the signal processing unit 122 and the power transformation module 11. In addition, the switch unit 121 switches on or off the control signal C based on the first switch signal SW1.

In some examples, the switch unit 121 includes at least one switch that is capable of switching connection paths for signals. For example, while activating the self-adaptive illumination device 100, the signal processing unit 122 generates the control signal C in a way for initially testing the illuminating unit 21, e.g., by activating a first set of switches of the switch unit 121. After the activation of the self-adaptive illumination device 100, the signal processing unit 122 generates the control signal C in a way that the self-adaptive illumination device 100 enters a normal mode, e.g. by activating a second set of switches of the switch 121 that is different or even non-overlapping with the first set of switches.

Figure 3:
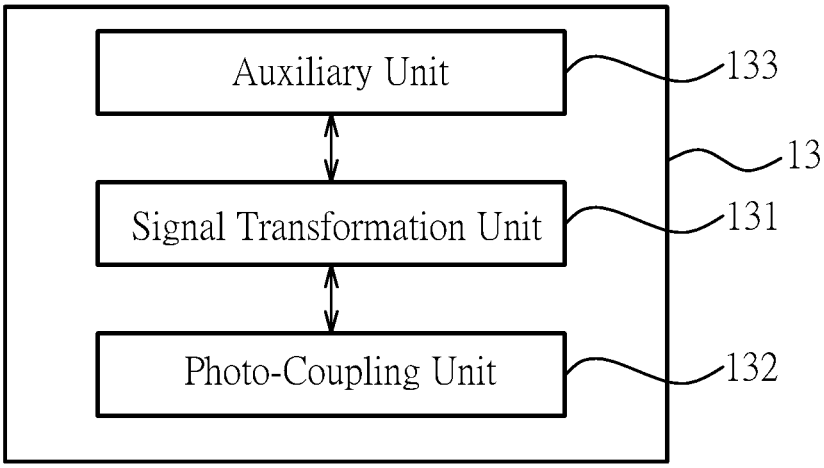
FIG. 3 illustrates a detailed schematic diagram of the sampling transformation module shown in FIG. 1 according to one example.

FIG. 3 illustrates a detailed schematic diagram of the sampling transformation module 13 shown in FIG. 1, according to one example. Specifically, the sampling transformation module 13 includes a signal transformation unit 131, a photo-coupling isolation unit 132 and an auxiliary unit 133.

The signal transformation unit 131 is electrically coupled to the sampling module 22. Also, the signal transformation unit 131 generates a third feedback signal F3 based on the first feedback signal F1, for example, in a way that the third feedback signal F3 is more suitable for a following photo-coupling isolation than the first feedback signal F1 is.

The photo-coupling isolation unit 132 is electrically coupled to the signal transformation unit 131. And the signal transformation unit 132 performs photo-coupling isolation on the third feedback signal F3 for generating the second feedback signal F2. Specifically, the photo-coupling isolation unit 132 filters off substantial noises from the third feedback signal F3. Such that the second feedback signal F2 has significantly smaller noise than both the feedback signals F1 and F3. In this fashion, the control module 12 can generate the required operation signal Op in a more precise manner.

The auxiliary unit 133 is electrically coupled to the signal transformation unit 131 for powering up the signal transformation unit 131. In some examples, the auxiliary unit 133 is implemented using a DC power transformation chip.

FIG. 4 illustrates an exemplary detailed circuit diagram of the self-adaptive illumination device 100 according to one example.

Specifically, the signal processing unit 122 includes a microcontroller U3, a first n-type bipolar junction transistor (BJT) Q1 and a second n-type BJT Q2.

The microcontroller U3, as well as the other following-mentioned microcontroller or chips, is capable of highly-efficient calculation, storage and analysis. Also, the microcontroller U3 is advantageous in its low power consumption, strong control functions, and high design flexibility. Such that using the microcontroller U3 or the like introduces the abovementioned advantages to the self-adaptive illuminating device 100 as well.

The microcontroller U3 has: (1) a power terminal VDD that is electrically coupled to an input power source V1; (2) a ground terminal VSS that is electrically coupled to ground GND; and (3) a first data I/O terminal PA0 that is electrically coupled to the switch unit 121.

The first BJT Q1 has: (1) an emitter that is electrically coupled to a second data I/O terminal PA1 of the microcontroller U3 and ground GND; and (2) a collector that is electrically coupled to the input power source V1 and the power transformation module 11.

The second n-type BJT Q2 has: (1) a collector that is electrically coupled to a base of the first n-type BJT Q1 and the collector of the first n-type BJT Q1; and (2) a base that is electrically coupled to the second data I/O terminal PA1 and an emitter of the second n-type BJT Q2.

The signal processing unit 122 also includes a first resistor R4, a second resistor R5, a third resistor R6, a fourth resistor R7 and a fifth resistor R8.

The first resistor R4 is electrically coupled between the second data I/O terminal PA1 of the microprocessor U3 and the base of the second n-type BJT Q2. The second resistor R5 is electrically coupled between a third data I/O terminal PA2 of the microprocessor U3 and the collector of the first n-type BJT Q1. The third resistor R6 is electrically coupled between the base and the emitter of the second n-type BJT Q2. The fourth resistor R7 is electrically coupled between the collector of the second n-type BJT Q2 and the input power source V1. The fifth resistor R8 is electrically coupled between the collector of the first n-type BJT Q1 and the input power source V1.

In some examples, the microcontroller U3 further has: (1) a fourth data I/O terminal PA7 that is electrically coupled to the photo-coupling isolation unit 132 of the sampling transformation module 13; (2) a fifth data I/O terminal PA5 that is electrically coupled to the switch unit 121 for controlling the switch unit 121's PWM status; and (3) a sixth data I/O terminal PA6 that is electrically coupled to a main power source V2.

In some examples, the input power source V1 may be an AC or DC power source that has a voltage level of 3.3 volts. And the main power source V2 may be a DC power source that has a voltage level of 12 volts.

In some examples, the switch unit 121 includes a microcontroller U4. And the microcontroller U3's first data I/O terminal PA0 is electrically coupled to the microcontroller U4's control signal input terminal X1. Such that the microcontroller U4 enables a path that allows a first control signal PWM2. And the allowed path passes through the microcontroller U4's control signal output terminal X, the power transformation module 11 and the microcontroller U3. The microcontroller U3's fifth data I/O terminal PA5 is electrically coupled to the microcontroller U4's switch control signal input terminal 20, which may receive a control signal PWM1 or the control signal PWM2 for responding to different pulse-width modulation signals.

Upon activating the self-adaptive illuminating device 100, the microcontroller U3 generates the first control signal PWM2 for connecting the microcontroller U4's control signal input terminal X1 to its control signal output terminal X. Such that the microcontroller U3 is switched to be electrically coupled to the power transformation module 11. The microcontroller U3 passes the first control signal PWM2 to the power transformation module 11 via the microcontroller U3's first data I/O terminal PA0, the microcontroller U4's control signal input terminal X1 and control signal output terminal X. Such that the power transformation module 11 generates the test signal t based on the control signal PWM2.

After activating the self-adaptive illuminating device 100, the microcontroller U3 generates a control signal PWM1 that renders the microcontroller U4 to enable a corresponding path, e.g., a path to the illuminating unit 21's illumination adjusting circuit.

In some examples, the first switch Q1 and the second switch Q2 acts as appropriate switches to enable bidirectional communication between the power transformation module 11 and the control module 12. Specifically, the microcontroller U3 outputs at least one operational parameter from its data transmitting terminal TX, i.e., its second data I/O terminal PA1. The at least one operational parameter then in turn travels through the first resistor R4, the second switch Q2's base and collector, and the first switch Q1's base and collector, and last reaches the power transformation module 11. Then, the power transformation module 11 outputs a status signal, which passes through the first switch Q1's collector, the second resistor R5, and the microcontroller U3's data receiving terminal RX, i.e., the microcontroller U3's third data I/O terminal PA2. The status signal may refer to occurrence of the self-adaptive illuminating device 100's malfunctioning. Also, the microcontroller U3 records and analyzes the status signal and controls the power transformation module 11 using a corresponding analysis result. For example, when the status signal indicates a severe malfunctioning, the microcontroller U3 controls the power transformation module 11 to switch off or lower its output DC power.

In some examples, the signal transformation unit 13 includes a socket chip U1. Specifically, the socket chip has: (1) a test terminal Rdim+ that is electrically coupled to the sampling module 22; (2) a primary power terminal VCC that is electrically coupled to the main power source V2; (3) a ground terminal GND and a secondary power terminal VFSS electrically coupled to each other; (4) an output terminal Iout electrically coupled to the photo-coupling isolation unit 132; and (5) a program terminal R×D electrically coupled to the sampling module 22 and acts as a following-described signal transformation unit 116's first feedback signal input terminal.

In addition, the signal transformation unit 13 includes a first capacitor C1, a second capacitor C2, a third capacitor C3, a first resistor R1, a first diode D1, a second diode D2, a second resistor R2 and a third resistor R3.

The first capacitor C1 is electrically coupled between the test terminal Rdim+ and the program terminal R×D of the socket chip U1. The second capacitor C2 is electrically coupled between the primary power terminal VCC and the ground terminal GND of the socket chip U1. The third capacitor C3 is electrically coupled to the second capacitor C2 in parallel. The first resistor R1 has a first terminal that is electrically coupled to the test terminal Rdim+ of the socket chip U1. The first diode D1 has: (1) a positive terminal that is electrically coupled to a second terminal of the first resistor R1; and (2) a negative terminal that is electrically coupled to the sampling module 22. The second diode D2 is electrically coupled between the test terminal Rdim+ and the primary power terminal VCC of the socket chip U1. The second resistor R2 is electrically coupled between the test terminal Rdim+ and the output terminal Iout of the socket chip U1. The third resistor R3 is electrically coupled between the output terminal Iout and the ground terminal GND of the socket chip U1. And the third resistor R3 is further electrically coupled between two terminals A and C of the photo-coupling isolation unit 132. Exemplarily, the photo-coupling isolation unit 132 is implemented using a microcontroller U2.

Figure 5:
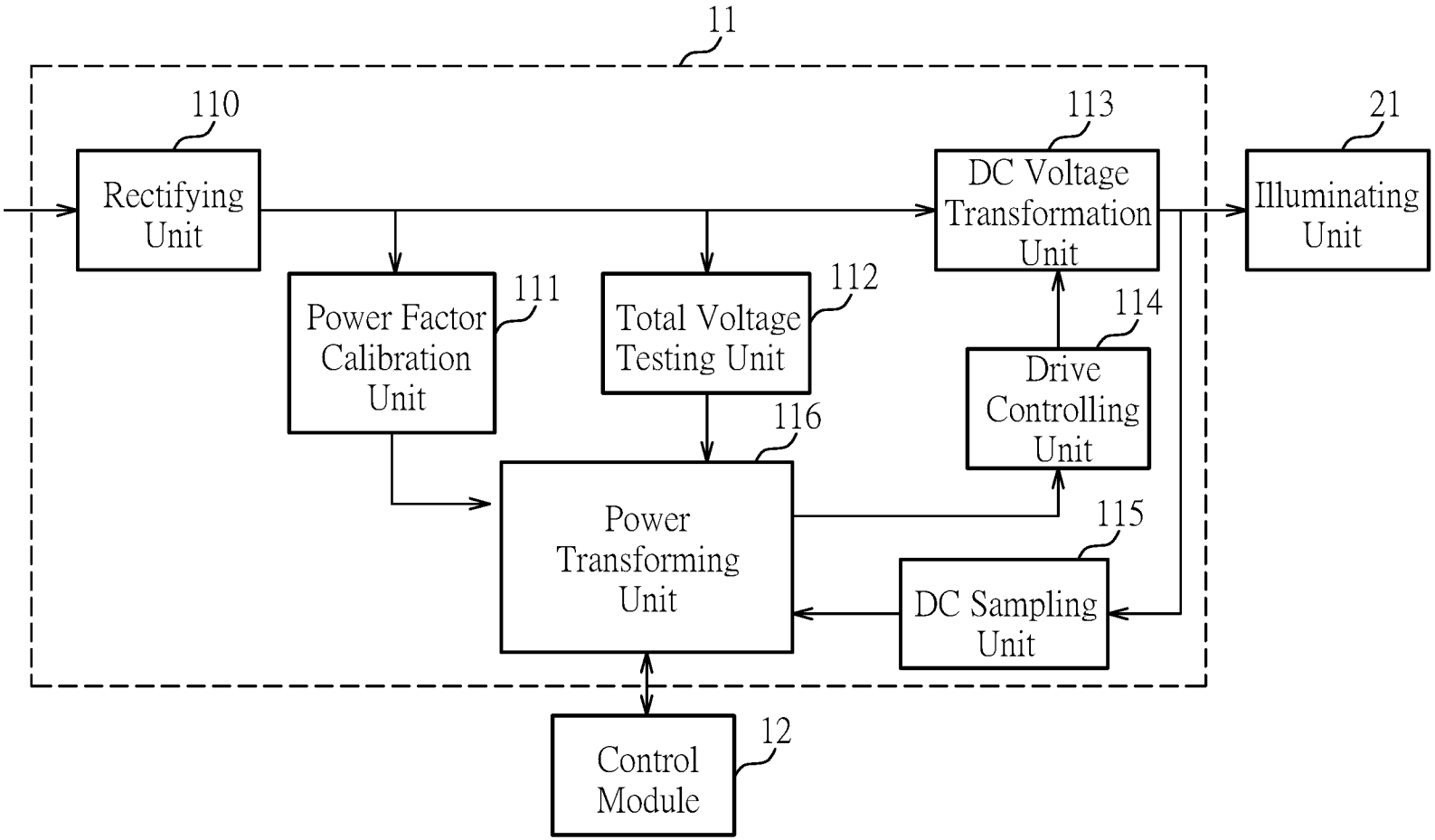
FIG. 5 illustrates an exemplary schematic diagram of the power transformation module shown in FIG. 1 according to one example.

FIG. 5 illustrates an exemplary schematic diagram of the power transformation module 11 shown in FIG. 1. Specifically, the power transformation module 11 includes the power transforming unit 116, a power factor calibration unit 111, a rectifying unit 110, a DC voltage transformation unit 113, a total voltage testing unit 112, a drive controlling unit 114 and a DC sampling unit 115.

The power transforming unit 116 is electrically coupled to the control module 12. Also, the power transforming unit 116 generates the test signal t using the first control signal PWM2.

The power factor calibration unit 111 is electrically coupled to the power transforming unit 116. In addition, the power factor calibration unit 111 generates a calibration signal based on a rectified voltage.

The rectifying unit 110 is electrically coupled to the power factor calibration unit 111. Additionally, the rectifying unit 110 rectifies the input voltage from the input power source V1 to generate the rectified voltage.

The DC voltage transformation unit 113 is electrically coupled to the rectifying unit 110 and the illuminating unit 21.

The total voltage testing unit 112 is electrically coupled to the rectifying unit 110 and the power transformation unit 116. Moreover, the total voltage testing unit 112 tests the rectified voltage to generate the test signal t.

The drive controlling unit 114 is electrically coupled to the power transformation unit 116 and the DC voltage transformation unit 113. And the drive controlling unit 114 generates a drive signal based on the test signal t.

The DC sampling unit 115 is electrically coupled to the power transformation unit 116. Also, the DC sampling unit 115 samples the drive voltage Dr to generate a sample signal.

The DC voltage transformation unit 113 additionally performs AC-to-DC voltage transformation on the rectified voltage. Also, the DC voltage transformation unit 113 adjusts the rectified voltage using the drive signal for generating the drive voltage Dr.

Figure 6:
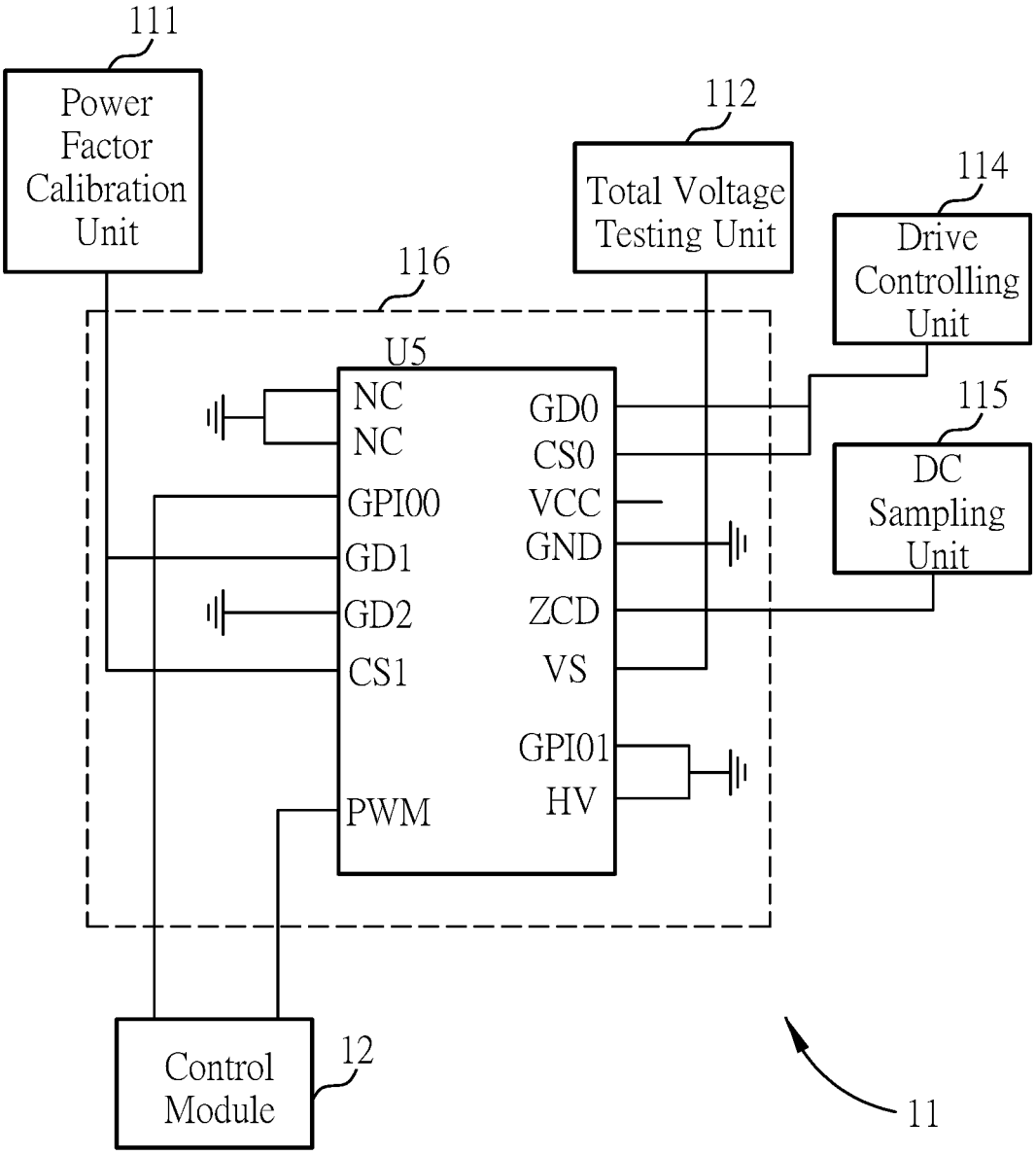
FIG. 6 illustrates an exemplary diagram of the power transformation unit shown in FIG. 5 according to one example.

FIG. 6 illustrates an exemplary diagram of the power transformation unit 116 shown in FIG. 5. Specifically, the power transformation unit 116 includes a power transformation chip U5.

The power transformation chip U5 has a calibration drive terminal GD1 and a calibration current test terminal CS1, both of which constitute the power transformation unit 116's calibration signal input terminal. In addition, both the calibration drive terminal GD1 and the calibration current test terminal CS1 of the power transformation chip U5 are electrically coupled to the power factor calibration unit 111.

The power transformation chip U5 has a first data I/O terminal GPI00, which acts as the power transformation unit 116's operational parameter input terminal or even a status signal output terminal. Also, the power transformation chip U5's first data I/O terminal GPI00 is electrically coupled to the control module 12.

As can be observed in FIG. 4 and FIG. 6, the power transformation chip U5's first data I/O terminal GPI00 is electrically coupled to a collector of the control module 12's first switch Q1 and the microcontroller U3's third data I/O terminal PA2 and second data I/O PA1. Such that communications between the microcontroller U3 and the power transformation chip U5 is enabled. In addition, the power transformation chip U5's pulse width modulation (PWM) signal terminal PWM acts as the power transformation unit 116's first control signal input terminal.

Moreover, the power transformation chip U5's PWM signal terminal PWM is electrically coupled to the microcontroller U4's control signal input terminal X. Such that the microcontroller U3's generated first control signal PWM2 passes through the microcontroller U4's control signal input terminal X1 and control signal output terminal X and reaches the power transformation chip U5's PWM signal terminal PWM. In this way, the communications between the microcontroller U3 and the power transformation chip U5 is enabled. Note that the power transformation chip U5's PWM signal terminal PWM acts as the power transformation unit 116's first control signal input terminal.

The power transformation chip U5 has a feedback drive terminal GD0 and a feedback current test terminal CS0, both of which are electrically coupled to the drive control unit 114. Through the drive control unit 114's control over the power transformation chip U5's output. The power transformation chip U5's feedback drive terminal GD0 and feedback current test terminal CS0 constitute the power transformation unit 116's drive signal output terminal.

The power transformation unit U5's zero-crossing detection terminal ZCD is electrically coupled to the DC sampling unit 115. Also, the power transformation unit U5's zero-crossing detection terminal ZCD acts as the power transform module 116's DC sampling signal input terminal. In some examples, the DC sampling unit 115 is implemented using a voltage transformer, which samples the power transformation module 11's output DC power source, generates a corresponding DC sampling signal, and feedbacks the DC sampling signal to the power transformation chip U5.

The power transformation chip U5's total voltage test terminal VS is electrically coupled to the total voltage test unit 112. In addition, the power transformation chip U5's total voltage test terminal VS acts as the power transformation unit 116's test signal input terminal. The total voltage test unit 112 tests the rectified voltage and generates the test signal t correspondingly. Specifically, the tests may include overvoltage detection and/or undervoltage detection. And the test signal t is then relayed to the power transformation chip U5.

In some examples, the power transformation chip U5's ground terminal GND, two null terminals NC, a second data I/O terminal GPI01, and a high voltage terminal HV are electrically coupled to the ground GND.

The following paragraphs summarizes how the self-adaptive illuminating device 100 shown in FIG. 1-FIG. 6.

In one embodiment, upon activating the self-adaptive illuminating device 100, the microcontroller U3 generates the first control signal PWM2 and in turn controls the microcontroller U4 to switch on a path that corresponds to the first control signal PWM2. That is, when the first control signal PWM2 renders the microcontroller U4's control signal input terminal X1 is electrically coupled to its control signal output X, the first control signal PWM2 generated by the microcontroller U3 passes through the microcontroller U4's control signal input terminal X1 and control signal output X and reaches the power transformation chip U5's PWM signal terminal PWM. The power transformation chip U5 generates a first test signal t based on the first control signal PWM2. And in turn the first test signal t is used for sampling the illuminating unit 21 via the sampling resistor Rset, and a first feedback signal F1 is generated correspondingly. The first feedback signal F1 is relayed to the socket chip U1 via its programmable terminal R×D, such that the socket chip U1 generates the third feedback signal F3 based on the first feedback signal F1. The third feedback signal F3 travels through the socket chip U1's output terminal Iout and the photo-coupler U2's first input terminal A and reaches the photo-coupler U2. In this way, the photo-coupler U2 generates the second feedback signal F2 based on the third feedback signal F3. The second feedback signal F2 is relayed to the microcontroller U3 via the photo-coupler U2's output terminal D and the microcontroller U3's fourth data I/O terminal PA7. Then, the microcontroller U3 references its association history for at least one operational parameter that corresponds to current values of the second feedback signal F2. The at least one operational parameter is transmitted to the power transformation chip U5 via the microcontroller U3's second data I/O terminal PA1 and the power transformation chip U5's first data I/O terminal GIP00. In this fashion, the power transformation chip U5 generates the drive signal Dr according to the at least one operational parameter. Also, the power transformation module 11's drive control unit 114 controls the DC transformation unit 113 based on the first test signal t and the drive signal Dr for performing DC conversion. As a result, a DC power is generated to drive the illuminating unit 21.

The power transformation chip U5's first data I/O terminal GIP00 acts as the power transformation unit 116's socket communication terminal. Therefore, the power transformation unit 116 can further relay a status signal to the microcontroller. The path of relaying the status signal includes the power transformation chip U5's first data I/O terminal GIP00, the first switch Q1's collector and the resistor R5. In addition, the status signal carries the power transformation chip U5's status information. Therefore, the microcontroller U3 analyzes the status signal and controls the DC power generated by the power transformation module 11 based on a result of analyzing the status signal.

In another embodiment, upon activation of the self-adaptive illuminating device 100, the socket chip U1 generates the test signal t. In turn, the test signal t is relayed to the sampling resistor Rset via the socket chip U1's voltage test terminal Rdim+, the resistor R1, and the first diode D1. Then, the sampling resistor Rset generates the first feedback signal F1 according to the test signal t. The first feedback signal F1 is then relayed to the socket chip U1 via the socket chip U1's programmable terminal R×D. And the socket chip U1 generates the third feedback signal F3 based on the first feedback signal F1. The third feedback signal F3 is transmitted to the photo-coupler U2 via the socket chip U1's output terminal Iout and the photo-coupler U2's first input terminal A. The photo-coupler U2 generates the second feedback signal F2 based on the third feedback signal F3. Then the third feedback signal F3 is transmitted to the microcontroller U3 via the photo-coupler U2's output terminal D and the microcontroller U3's fourth data I/O terminal PA7. In this fashion, the microcontroller U3 references its pre-stored association history for determining at least one operational parameter that corresponds to the second feedback signal F2. And the at least one operational parameter is transmitted to the power transformation chip U5 via the microcontroller U3's second data I/O terminal PA1 and the power transformation chip U5's first data I/O terminal GIP00. In turn, the power transformation chip U5 generates the drive signal Dr according to the at least one operational parameter. And the power transformation module 11's drive control unit 114 utilizes the first test signal t and the drive control signal Dr to control the DC transformation unit 113, which then perform DC conversion to generate a DC power. Last, the DC power is used for driving the illuminating unit 21.

The power transformation chip U5's first data I/O terminal GIP00 acts as the power transformation unit 116's socket communication terminal. Therefore, the power transformation unit 116 can further transmit a status signal to the microcontroller U3 via the power transformation chip U5's first data I/O terminal GIP00 and the resistor R5. In addition, the status signal includes the power transformation unit U5's statuses. In this way, the microcontroller U3 analyzes the status signal, and controls the power transformation module 11's generated DC power according to a result of analyzing the status signal.

In some examples, the auxiliary unit 133's DC conversion voltage outputs the DC voltage V2 to power up the socket chip U1. In one example, the voltage V2 is substantially equal to 12 volts.

After activation of the self-adaptive illuminating device 100, the microcontroller U3 generates a second control signal PWM1 to render the microcontroller U4 to switch on the illuminance adjusting terminal X0, such that a path that corresponds to the second control signal PWM1 is enabled. For example, the path connects a luminance adjusting circuit and the microcontroller U3. And with the aid of the second control signal PWM1, the microcontroller U4 is switched to connect the luminance adjusting circuit and the microcontroller U3. In this way, a regular luminance adjusting device that includes the luminance adjusting circuit can adjust the illuminating unit 21's luminance.

Because before activating the illuminating unit 21, the required at least one operational parameter is generated via the sampling resistor Rset, the socket chip U1 and the microcontroller U3, the power transformation module 11 may generates a corresponding DC power to drive the illuminating unit 21. In this fashion, every installation of the illuminating unit 21 is substantially free from changing its hardware wiring. And it helps avoiding installation errors and/or fabrication errors. In practical usage of the self-adaptive illuminating device 100, it can also be applied to multiple illuminating units and even multiple sets of illuminating units.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A self-adaptive illuminating device, comprising:

an illuminating unit;

a sampling module, electrically coupled to the illuminating unit, and configured to sample at least one electrical property of the illuminating unit to generate a first feedback signal in response to a test signal, wherein a sampling transformation module comprises a signal transformation unit, a photo-coupling isolation unit and an auxiliary unit, wherein the signal transformation unit is electrically coupled to the sampling module, and configured to generate a third feedback signal based on the first feedback signal, the photo-coupling isolation unit is electrically coupled to the signal transformation unit, and configured to perform photo-coupling isolation on the third feedback signal for generating the second feedback signal, and the auxiliary unit is electrically coupled to the signal transformation unit for powering up the signal transformation unit;

a sampling transformation module, electrically coupled to a sampling module, and configured to filter out noises off the first feedback signal for generating a second feedback signal, wherein the sampling transformation module comprises the signal transformation unit, the photo-coupling isolation unit and the auxiliary unit, the signal transformation unit is electrically coupled to the sampling module, and configured to generate a third feedback signal based on the first feedback signal, the photo-coupling isolation unit is electrically coupled to the signal transformation unit, and configured to perform photo-coupling isolation on the third feedback signal for generating the second feedback signal, and the auxiliary unit is electrically coupled to the signal transformation unit for powering up the signal transformation unit;

a control module, electrically coupled to the sampling transformation module, and configured to generate an operation signal that carries at least one operational parameter of the illuminating unit in response to the second feedback signal; and a power transformation module, electrically coupled to the control module, configured to generate a drive voltage corresponding to an input voltage and the operation signal, and configured to drive the illuminating unit using the drive voltage, wherein the power transformation module comprises:

a power transforming unit, electrically coupled to the control module, configured to generate the test signal using a first control signal;

a power factor calibration unit, electrically coupled to the power transforming unit, and configured to generate a calibration signal based on a rectified voltage;

a rectifying unit, electrically coupled to the power factor calibration unit, and configured to rectify the input voltage to generate the rectified voltage;

a DC voltage transformation unit, electrically coupled to the rectifying unit and the illuminating unit;

a total voltage testing unit, electrically coupled to the rectifying unit and the power transformation unit, and configured to test the rectified voltage to generate the test signal;

a drive controlling unit, electrically coupled to the power transformation unit and the DC voltage transformation unit, and configured to generate a drive signal based on the test signal; and a DC sampling unit, electrically coupled to the power transformation unit, and configured to sample the drive voltage to generate a sample signal;

wherein the DC voltage transformation unit is configured to perform AC-to-DC voltage transformation on the rectified voltage and to adjust the rectified voltage using the drive signal for generating the drive voltage.

2. The self-adaptive illuminating device of claim 1, wherein the control module is further configured to store associations between values of the test signal, the feedback signals and the operation signal.

3. The self-adaptive illuminating device of claim 2, wherein the values of the test signal comprise values of test voltages, test currents, test pulse-width-modulation (PWM) signals, and test carrier signals;

wherein the values of the feedback signals comprise values of feedback voltages, feedback currents, feedback PWM signals, and feedback carrier signals; and wherein the values of the operation signal comprise values of operational voltages, operational currents, operational PWM signals, and operations carrier signals.

4. The self-adaptive illuminating device of claim 1, wherein the control module is further configured to generate a control signal, and the power transformation module is further configured to generate the test signal based on the control signal;

wherein the illuminating unit is not activated via the test signal.

5. The self-adaptive illuminating device of claim 1, wherein a signal processing unit is further configured to reference association between values of the second feedback signal and the operation signal for determining at least one operation parameter to be utilized by the illuminating unit.

6. The self-adaptive illuminating device of claim 1, wherein the signal transformation unit is further configured to generate the test signal upon activating the self-adaptive illuminating device.

7. The self-adaptive illuminating device of claim 1, wherein the sampling module is electrically coupled to the illuminating unit in parallel.

8. The self-adaptive illuminating device of claim 1, wherein the sampling module is electrically coupled to the illuminating unit in series.

9. The self-adaptive illuminating device of claim 1, wherein the sampling module comprises at least one of a light-emitting diode (LED), a resistor, an inductor, a capacitor, an integrated circuit, and a microcontroller unit.

10. The self-adaptive illuminating device of claim 1, wherein the sampling module is integrated with the illuminating unit.

11. The self-adaptive illuminating device of claim 1, wherein the control module comprises:

a signal processing unit, electrically coupled to the sampling transformation module, configured to generate the operation signal, a first control signal and a first switch signal in response to the second feedback signal; and a switch unit electrically coupled to the signal processing unit and the power transformation module and configured to switch on or off the first control signal based on the first switch signal.

12. The self-adaptive illuminating device of claim 11, wherein the signal processing unit comprises:

a microcontroller, having a power terminal electrically coupled to an input power source, having a ground terminal electrically coupled to ground, and having a first data I/O terminal electrically coupled to the switch unit;

a first n-type bipolar junction transistor (BJT), having an emitter electrically coupled to a second data I/O terminal of the microcontroller and ground, and having a collector electrically coupled to the input power source and the power transformation module; and a second n-type BJT, having a collector electrically coupled to a base of the first n-type BJT and the collector of the first n-type BJT, and having a base electrically coupled to the second data I/O terminal and an emitter of the second n-type BJT.

13. The self-adaptive illuminating device of claim 12, wherein the signal processing unit further comprises:

a first resistor, electrically coupled between the second data I/O terminal of the microprocessor and the base of the second n-type BJT;

a second resistor, electrically coupled between a third data I/O terminal of the microprocessor and the collector of the first n-type BJT;

a third resistor, electrically coupled between the base and the emitter of the second n-type BJT;

a fourth resistor, electrically coupled between the collector of the second n-type BJT and the input power source; and a fifth resistor electrically coupled between the collector of the first n-type BJT and the input power source.

14. The self-adaptive illuminating device of claim 12, wherein the microcontroller further has a fourth data I/O terminal that is electrically coupled to a photo-coupling isolation unit of the sampling transformation module, further has a fifth data I/O terminal that is electrically coupled to the switch unit for controlling a PWM status of the switch unit, and further has a sixth data I/O terminal that is electrically coupled to a main power source.

15. The self-adaptive illuminating device of claim 1, wherein the signal transformation unit further comprises:

a first capacitor, electrically coupled between the test terminal and the program terminal of the socket chip;

a second capacitor, electrically coupled between the primary power terminal and the ground terminal of the socket chip;

a third capacitor, electrically coupled to the second capacitor in parallel;

a first resistor, having a first terminal electrically coupled to the test terminal of the socket chip;

a first diode, having a positive terminal electrically coupled to a second terminal of the first resistor, and having a negative terminal electrically coupled to the sampling module;

a second diode, electrically coupled between the test terminal and the primary power terminal of the socket chip;

a second resistor, electrically coupled between the test terminal and the output terminal of the socket chip; and a third resistor electrically coupled between the output terminal and the ground terminal of the socket chip, wherein the third resistor is further electrically coupled between two terminals of the photo-coupling isolation unit.

16. The self-adaptive illuminating device of claim 1, wherein the sampling module comprises:

a sampling resistor electrically coupled to the illuminating unit in parallel or in series.

17. The self-adaptive illuminating device of claim 1, wherein the power transformation unit comprises a power transformation chip that has at least one data I/O terminal that is electrically coupled to the control module, the power factor calibration unit, the total voltage testing unit, the drive controlling unit, and the DC sampling unit.

* * * * *